US008690638B2

(12) United States Patent
Hayashida et al.

(10) Patent No.: US 8,690,638 B2
(45) Date of Patent: Apr. 8, 2014

(54) CURVED PLASTIC OBJECT AND SYSTEMS AND METHODS FOR DEBURRING THE SAME

(75) Inventors: Jeff Hayashida, San Francisco, CA (US); Jonathan Aase, Redwood City, CA (US)

(73) Assignee: Apple Inc., Cupertino, CA (US)

( * ) Notice: Subject to any disclaimer, the term of this patent is extended or adjusted under 35 U.S.C. 154(b) by 362 days.

(21) Appl. No.: 13/107,325

(22) Filed: May 13, 2011

(65) Prior Publication Data

US 2012/0088059 A1 Apr. 12, 2012

Related U.S. Application Data

(60) Provisional application No. 61/390,936, filed on Oct. 7, 2010.

(51) Int. Cl.
*B24B 1/00* (2006.01)

(52) U.S. Cl.
USPC ..... 451/28; 451/165; 451/61; 451/104; 451/108

(58) Field of Classification Search
USPC ..... 451/28, 60, 165, 74, 104, 108, 113, 61
See application file for complete search history.

(56) References Cited

U.S. PATENT DOCUMENTS

| | | | | | |
|---|---|---|---|---|---|
| 1,233,701 | A * | 7/1917 | Pfeifer | ..... | 451/180 |
| 1,246,996 | A * | 11/1917 | Pfeifer | ..... | 451/180 |
| 2,711,927 | A * | 6/1955 | Miller et al. | ..... | 239/276 |
| 2,825,186 | A * | 3/1958 | Palush | ..... | 451/165 |
| 3,699,719 | A * | 10/1972 | Rozdilsky et al. | ..... | 451/60 |
| 4,122,603 | A * | 10/1978 | Sastri | ..... | 30/346.5 |
| 4,165,201 | A * | 8/1979 | Heule | ..... | 408/187 |
| 4,343,111 | A * | 8/1982 | Inoue | ..... | 451/28 |
| 4,689,921 | A * | 9/1987 | Murate et al. | ..... | 451/36 |
| 4,757,647 | A * | 7/1988 | Hunziker | ..... | 451/80 |
| 4,850,151 | A * | 7/1989 | Ditscherlein | ..... | 451/327 |
| 4,934,103 | A * | 6/1990 | Campergue et al. | ..... | 451/165 |
| 4,999,954 | A * | 3/1991 | Miyamoto et al. | ..... | 451/5 |
| 5,054,244 | A * | 10/1991 | Takamatsu et al. | ..... | 451/5 |
| 5,125,191 | A * | 6/1992 | Rhoades | ..... | 451/36 |
| 5,179,805 | A * | 1/1993 | Numao et al. | ..... | 451/312 |
| 5,347,763 | A * | 9/1994 | Miyamato et al. | ..... | 451/241 |
| 5,404,680 | A * | 4/1995 | Mizuguchi et al. | ..... | 451/36 |
| 5,681,209 | A * | 10/1997 | Naumann et al. | ..... | 451/51 |
| 5,792,334 | A * | 8/1998 | Asai et al. | ..... | 205/206 |
| 6,027,399 | A * | 2/2000 | Stewart | ..... | 451/353 |
| 6,612,906 | B2 * | 9/2003 | Benderly | ..... | 451/29 |
| 6,729,937 | B2 * | 5/2004 | Kawasaki | ..... | 451/10 |
| 6,962,522 | B1 * | 11/2005 | Kawasaki et al. | ..... | 451/113 |
| 2001/0041502 | A1 * | 11/2001 | Kawasaki et al. | ..... | 451/28 |
| 2002/0009956 | A1 * | 1/2002 | Gilmore et al. | ..... | 451/113 |
| 2002/0187729 | A1 * | 12/2002 | Osugi et al. | ..... | 451/28 |
| 2003/0143936 | A1 * | 7/2003 | Igarashi et al. | ..... | 451/390 |
| 2004/0000218 | A1 * | 1/2004 | Bergamo | ..... | 81/53.2 |
| 2007/0135025 | A1 * | 6/2007 | Huang | ..... | 451/59 |
| 2011/0183580 | A1 * | 7/2011 | Kenney | ..... | 451/28 |
| 2012/0088059 | A1 * | 4/2012 | Hayashida et al. | ..... | 428/80 |

* cited by examiner

*Primary Examiner* — George Nguyen

(74) *Attorney, Agent, or Firm* — Womble Carlyle Sandridge & Rice LLP

(57) ABSTRACT

Curved plastic objects and systems and methods for deburring the same are disclosed. The curved plastic object can be the cap or grill of a headphone or earbud.

18 Claims, 5 Drawing Sheets

CURVED PLASTIC OBJECT AND SYSTEMS AND METHODS FOR DEBURRING THE SAME

CROSS-REFERENCE TO RELATED APPLICATIONS

This application claims the benefit of previously filed U.S. Provisional Patent Application No. 61/390,936, filed on Oct. 7, 2010, entitled "CURVED PLASTIC OBJECT AND SYSTEMS AND METHODS FOR DEBURRING THE SAME," which is incorporated by reference herein in its entirety.

BACKGROUND

Wired headsets are commonly used with many portable electronic devices such as portable music players and mobile phones. Headsets can include non-cable components such as a jack, headphones, and/or a microphone and one or more cables that interconnect the non-cable components. Plastic headphones typically include holes that permit the passage of soundwaves from from the inside of the headphones to the outside of the headphones. The creation of these holes can result in remnants left in or around the holes that degrade the aesthetic and acoustic properties of the headphones. Therefore, what are needed are systems and methods for deburring curved plastic objects.

SUMMARY

Curved plastic objects and systems and methods for deburring the same are disclosed. The curved plastic object can be the cap or grill of a headphone or earbud.

According to some embodiments, a headphone can include a headphone cap with a number of holes extending from the inner surface to the outer surface. The inner and outer surfaces can be deburred and polished to ensure that no remnants remain in the holes or on any surface of the headphone.

In some embodiments, a tool for deburring a curved plastic object is disclosed. The tool can be coated in an abrasive material and substantially conform to the shape of the curved plastic object. The curved plastic surface can be deburred and polished by vibrating the tool while it is in contact with the curved plastic surface. Separate tools may be provided for deburring each side of the curved plastic object.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

DETAILED DESCRIPTION OF THE DISCLOSURE

Curved plastic objects and systems and methods for deburring the same are disclosed. The curved plastic object can be the cap or grill of a headphone or earbud. A number of holes extending from the inner surface to the outer surface of a headphone cap can be drilled or otherwise provided as described more fully below with respect to FIG. 2.

After the holes are created, tools with substantially the same shape as the inner and outer surface of the headphone cap can be used to deburr and polish each surface. The tool can be coated in an abrasive material suitable to remove remnants left over from the process that created the holes. The headphone cap can then be joined with a second headphone component to form a headphone. In some embodiments, the headphone can appear to be a one-piece unibody headphone, seamlessly joined from two headphone component pieces. The headphone can then be connected to a cable structure and other non-cable components as part of a headset.

Figure 1A:
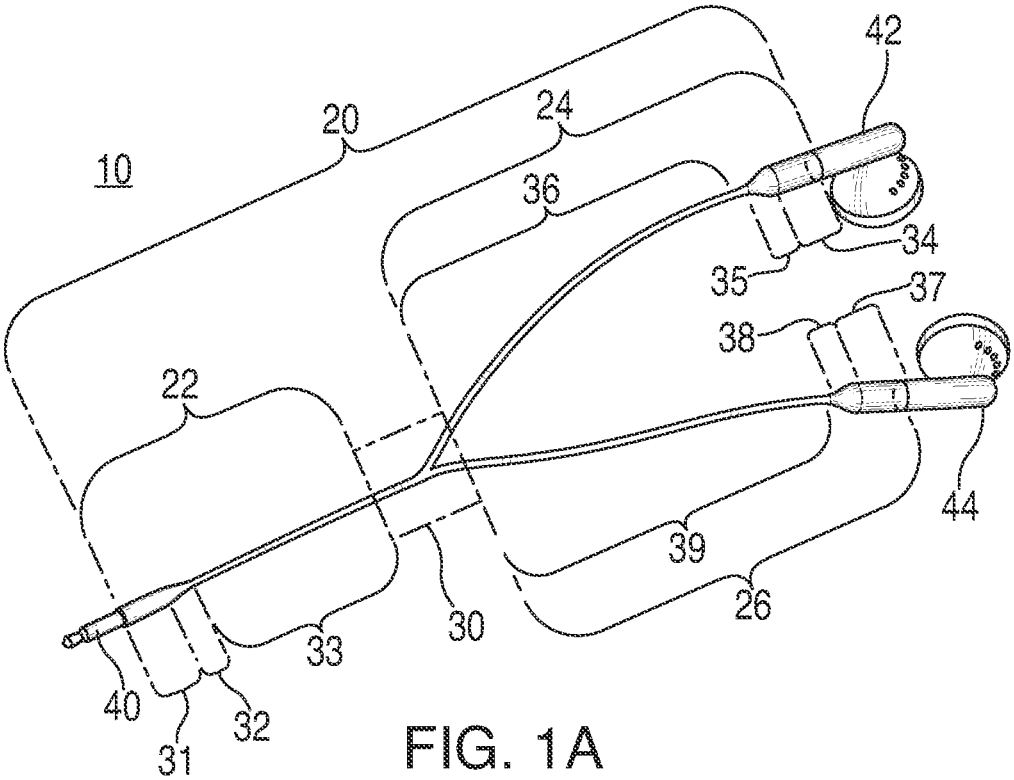
FIGS. 1A and 1B illustrate different headsets having a cable structure that seamlessly integrates with non-cable components in accordance with some embodiments of the invention.

FIG. 1A shows an illustrative headset 10 having cable structure 20 that seamlessly integrates with non-cable components 40, 42, 44. For example, non-cable components 40, 42, and 44 can be a male plug, a left headphone, and a right headphone, respectively. Cable structure 20 has three legs 22, 24, and 26 joined together at bifurcation region 30. Leg 22 may be referred to herein as main leg 22, and includes the portion of cable structure 20 existing between non-cable component 40 and bifurcation region 30. In particular, main leg 22 includes interface region 31, bump region 32, and non-interface region 33. Leg 24 may be referred to herein as left leg 24, and includes the portion of cable structure 20 existing between non-cable component 42 and bifurcation region 30. Leg 26 may be referred to herein as right leg 26, and includes the portion of cable structure 20 existing between non-cable component 44 and bifurcation region 30. Both left and right legs 24 and 26 include respective interface regions 34 and 37, bump regions 35 and 38, and non-interface regions 36 and 39.

Legs 22, 24, and 26 generally exhibit a smooth surface throughout the entirety of their respective lengths. Each of legs 22, 24, and 26 can vary in diameter, yet still retain the smooth surface.

Non-interface regions 33, 36, and 39 can each have a predetermined diameter and length. The diameter of non-interface region 33 (of main leg 22) may be larger than or the same as the diameters of non-interface regions 36 and 39 (of left leg 24 and right leg 26, respectively). For example, leg 22 may contain a conductor bundle for both left and right legs 24 and 26 and may therefore require a greater diameter to accommodate all conductors. In some embodiments, it is desirable to manufacture non-interface regions 33, 36, and 39 to have the smallest diameter possible, for aesthetic reasons. As a result, the diameter of non-interface regions 33, 36, and 39 can be smaller than the diameter of any non-cable component (e.g., non-cable components 40, 42, and 44) physically connected to the interfacing region. Since it is desirable for cable structure 20 to seamlessly integrate with the non-cable components, the legs may vary in diameter from the non-interfacing region to the interfacing region.

Bump regions 32, 35, and 38 provide a diameter changing transition between interfacing regions 31, 34, and 37 and respective non-interfacing regions 33, 36, and 39. The diameter changing transition can take any suitable shape that exhibits a fluid or smooth transition from any interface region to its respective non-interface region. For example, the shape of the bump region can be similar to that of a cone or a neck of a wine bottle. As another example, the shape of the taper region can be stepless (i.e., there is no abrupt or dramatic step change in diameter, nor a sharp angle at an end of the bump region). Bump regions 32, 35, and 38 may be mathematically represented by a bump function, which requires the entire diameter changing transition to be stepless and smooth (e.g., the bump function is continuously differentiable).

Interface regions 31, 34, and 37 can each have a predetermined diameter and length. The diameter of any interface region can be substantially the same as the diameter of the non-cable component it is physically connected to, to provide an aesthetically pleasing seamless integration. For example, the diameter of interface region 31 can be substantially the same as the diameter of non-cable component 40. In some embodiments, the diameter of a non-cable component (e.g., component 40) and its associated interfacing region (e.g., region 31) are greater than the diameter of the non-interface region (e.g., region 33) they are connected to via the bump region (e.g., region 32). Consequently, in this embodiment, the bump region decreases in diameter from the interface region to the non-interface region.

In another embodiment, the diameter of a non-cable component (e.g., component 40) and its associated interfacing region (e.g., region 31) are less than the diameter of the non-interface region (e.g., region 33) they are connected to via the bump region (e.g., region 32). Consequently, in this embodiment, the bump region increases in diameter from the interface region to the non-interface region.

The combination of the interface and bump regions can provide strain relief for those regions of headset 10. In one embodiment, strain relief may be realized because the interface and bump regions have larger dimensions than the non-interface region and thus are more robust. These larger dimensions may also ensure that non-cable portions are securely connected to cable structure 20. Moreover, the extra girth better enables the interface and bump regions to withstand bend stresses.

The interconnection of legs 22, 24, and 26 at bifurcation region 30 can vary depending on how cable structure 20 is manufactured. In one approach, cable structure 20 can be a single-segment unibody cable structure. In this approach all three legs are manufactured jointly as one continuous structure and no additional processing is required to electrically couple the conductors contained therein. That is, none of the legs are spliced to interconnect conductors at bifurcation region 30, nor are the legs manufactured separately and then later joined together. Some single-segment unibody cable structures may have a top half and a bottom half, which are molded together and extend throughout the entire unibody cable structure. For example, such single-segment unibody cable structures can be manufactured using injection molding and compression molding manufacturing processes (discussed below in more detail). Thus, although a mold-derived single-segment unibody cable structure has two components (i.e., the top and bottom halves), it is considered a single-segment unibody cable structure for the purposes of this disclosure. Other single-segment unibody cable structures may exhibit a contiguous ring of material that extends throughout the entire unibody cable structure. For example, such a single-segment cable structure can be manufactured using an extrusion process.

In another approach, cable structure 20 can be a multi-segment unibody cable structure. A multi-segment unibody cable structure may have the same appearance of the single-segment unibody cable structure, but the legs are manufactured as discrete components. The legs and any conductors contained therein are interconnected at bifurcation region 30. The legs can be manufactured, for example, using any of the processes used to manufacture the single-segment unibody cable structure.

The cosmetics of bifurcation region 30 can be any suitable shape. In one embodiment, bifurcation region 30 can be an overmold structure that encapsulates a portion of each leg 22, 24, and 26. The overmold structure can be visually and tactically distinct from legs 22, 24, and 26. The overmold structure can be applied to the single or multi-segment unibody cable structure. In another embodiment, bifurcation region 30 can be a two-shot injection molded splitter having the same dimensions as the portion of the legs being joined together. Thus, when the legs are joined together with the splitter mold, cable structure 20 maintains its unibody aesthetics. That is, a multi-segment cable structure has the look and feel of single-segment cable structure even though it has three discretely manufactured legs joined together at bifurcation region 30. Many different splitter configurations can be used, and the use of some splitters may be based on the manufacturing process used to create the segment.

Cable structure 20 can include a conductor bundle that extends through some or all of legs 22, 24, and 26. Cable structure 20 can include conductors for carrying signals from non-cable component 40 to non-cable components 42 and 44, which can be seamless, unibody headphones. A unibody headphone may be composed of two separate headphone components. According to some embodiments, one component can contain headphone components (e.g., speaker(s) and a circuit board that can connect to cable structure 20), while the other component can have ports to allow sound to be readily transmitted from the headphone. The two components can be welded together such that no air bubbles remain and gaps between the two components are completely filled in. The weld ring created at the interface of the two components can then be cut, sanded, polished, and cleaned, resulting in a headphone that appears to be of one-piece or unibody construction.

Cable structure 20 can include one or more rods constructed from a superelastic material. The rods can resist deformation to reduce or prevent tangling of the legs. The rods are different than the conductors used to convey signals from non-cable component 40 to non-cable components 42 and 44, but share the same space within cable structure 20. Several different rod arrangements may be included in cable structure 20.

In yet another embodiment, one or more of legs 22, 24, and 26 can vary in diameter in two or more bump regions. For example, the leg 22 can include bump region 32 and another bump region (not shown) that exists at leg/bifurcation region 30. This other bump region may vary the diameter of leg 22 so that it changes in size to match the diameter of cable structure at bifurcation region 30. This other bump region can provide additional strain relief.

Figure 1B:
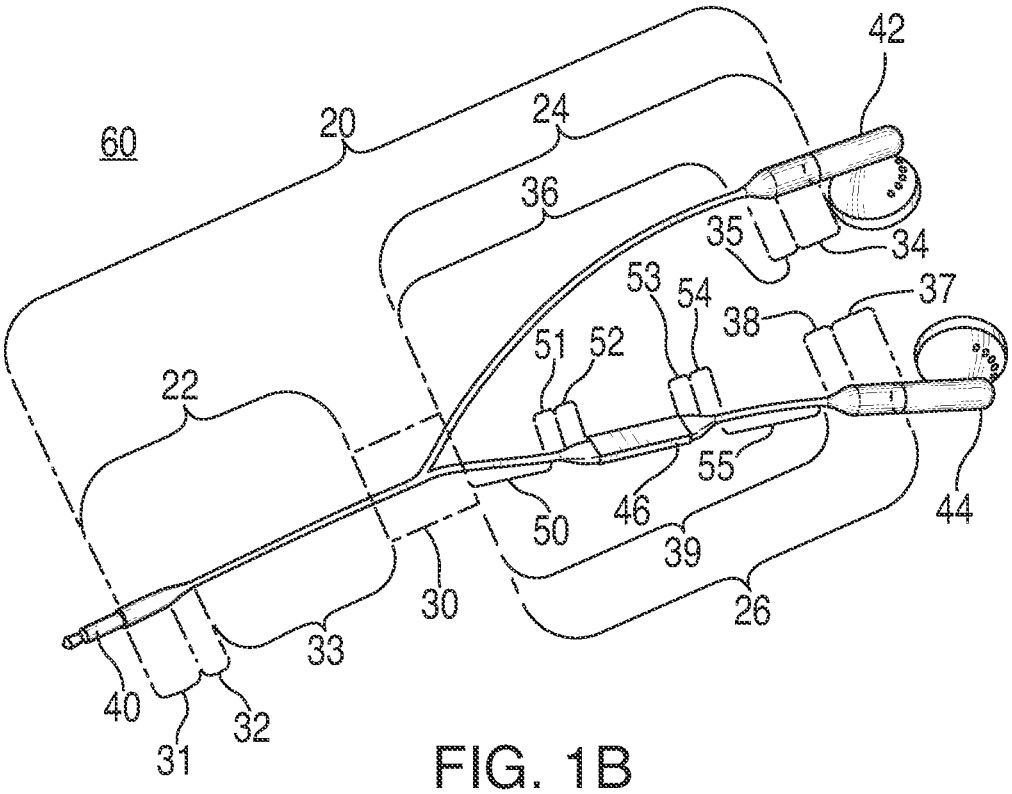

In some embodiments, another non-cable component can be incorporated into either left leg 24 or right leg 26. As shown in FIG. 1B, headset 60 shows that non-cable component 46 is integrated within leg 26, and not at an end of a leg like non-cable components 40, 42 and 44. For example, non-cable component 46 can be a communications box that includes a microphone and a user interface (e.g., one or more mechanical or capacitive buttons). Non-cable component 46 can be electrically coupled to non-cable component 40, for example, to transfer signals between communications box 46 and one or more of non-cable components 40, 42 and 44.

Non-cable component 46 can be incorporated in non-interface region 39 of leg 26. In some cases, non-cable component 46 can have a larger size or girth than the non-interface regions of leg 26, which can cause a discontinuity at an interface between non-interface region 39 and communications box 46. To ensure that the cable maintains a seamless unibody appearance, non-interface region 39 can be replaced by first non-interface region 50, first bump region 51, first interface region 52, communications box 46, second interface region 53, second bump region 54, and second non-interface region 55.

Similar to the bump regions described above in connection with the cable structure of FIG. 1A, bump regions 51 and 54 can handle the transition from non-cable component 46 to non-interface regions 50 and 55. The transition in the bump region can take any suitable shape that exhibits a fluid or smooth transition from the interface region to the non-interface regions. For example, the shape of the taper region can be similar to that of a cone or a neck of a wine bottle.

Similar to the interface regions described above in connection with the cable structure of FIG. 1A, interface regions 52 and 53 can have a predetermined diameter and length. The diameter of the interface region is substantially the same as the diameter of non-cable component 46 to provide an aesthetically pleasing seamless integration. In addition, and as described above, the combination of the interface and bump regions can provide strain relief for those regions of headset 10.

In some embodiments, non-cable component 46 may be incorporated into a leg such as leg 26 without having bump regions 51 and 54 or interface regions 52 and 53. Thus, in this embodiment, non-interfacing regions 50 and 55 may be directly connected to non-cable component 46.

Cable structures 20 can be constructed using many different manufacturing processes. The processes discussed herein include those that can be used to manufacture the single-segment unibody cable structure or legs for the multi-segment unibody cable structure. In particular, these processes include injection molding, compression molding, and extrusion. Embodiments of this invention use compression molding processes to manufacture a single-segment unibody cable structure or multi-segment unibody cable structures.

In one embodiment, a cable structure can be manufactured by compression molding two urethane sheets together to form the sheath of the cable structure. Using this manufacturing method, the finished cable structure has a bi-component sheath that encompasses a resin and a conductor bundle. The resin further encompasses the conductor bundle and occupies any void that exists between the conductor bundle and the inner wall of the bi-component cable. In addition, the resin secures the conductor bundle in place within the bi-component sheath.

Headphones 42 and 44 can be constructed to have any suitable shape and seamless unibody aesthetics even if the headphones are formed from at least two components that are welded together. The shape of the headphones can resemble those of non-occluding earbuds that fit in the ear, but do not form an airtight seal between the earbud and ear canal. This type of headphone typically has a cap portion and a body portion. The cap portion has one or more holes to permit passage of soundwaves from inside the headphones to the outside of the headphones. The cap portion and holes are also substantially free of any remnants.

In embodiments of this invention, the cap portion is constructed to have a relatively large number of ports or holes. For example, the number of holes may be in the hundreds. The number of holes may range from 200-1000, 300-900, 400-750, 500-600, 650-750, or 700-725. The number of holes can depend on the size of the holes, the available surface area in the cap suitable for hole placement, and a pattern in which holes reside in the available surface area. The holes may be sized to mitigate passage of particulate matter such as dust and water. Moreover, the use of such holes eliminates the need to use a wire mesh.

Figure 2:
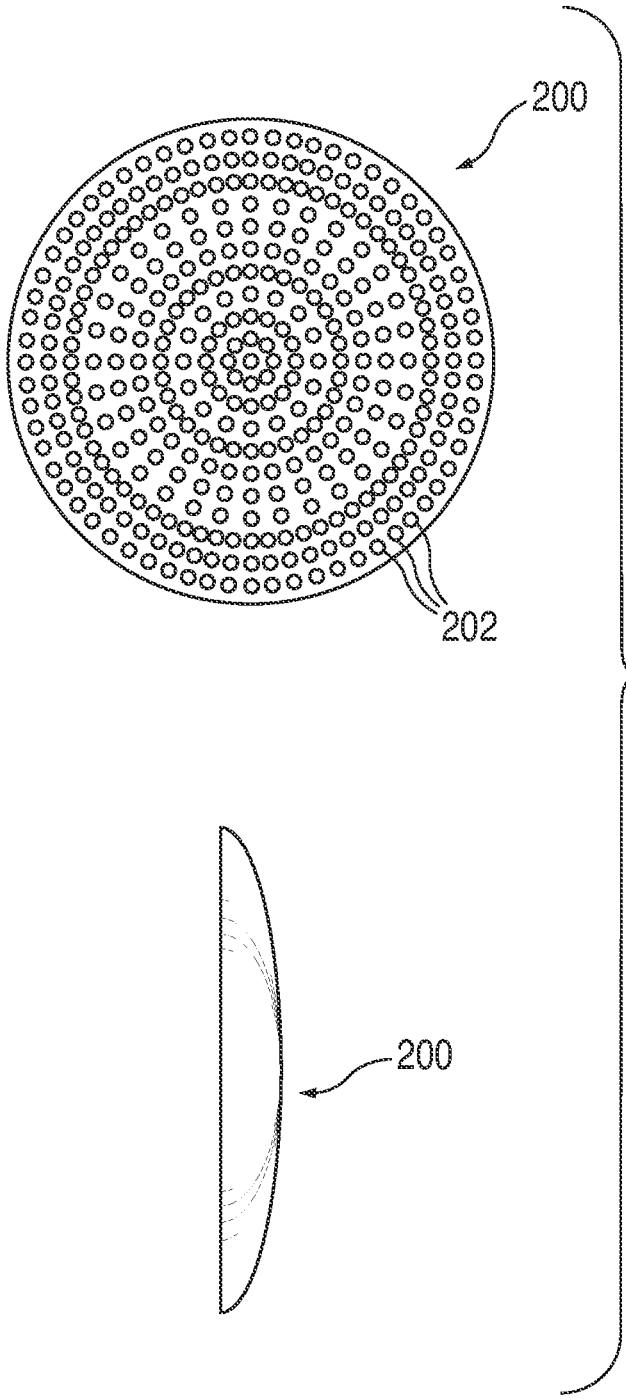
FIG. 2 shows an illustrative top and side views of a cap constructed in accordance with an embodiment of the invention.

FIG. 2 shows an illustrative top and side views of a cap 200 constructed according to an embodiment of the invention. Cap 200 includes several holes 202 disposed throughout. In one embodiment, cap 200 can have 721 holes, each having a diameter of about 0.2 mm, with about 0.14 mm of spacing between the holes. In another embodiment, cap 200 can have holes ranging in diameter between 0.2 mm and 0.45 mm. The side view shows that cap 200 can have a curved surface.

Cap 200 is constructed from a plastic material and the holes can be provided in one of two approaches. In the first approach, each of holes 202 is individually drilled in a cap that initially has no holes. The holes may be drilled one at time or simultaneously. After the holes are drilled, remnants of drilled plastic may remain in or around the holes, and in some cases, some plastic remnants may be partially attached to their respective holes. These remnants detract from a desired aesthetic look and feel of a finished cap and thus need to be deburred and removed using methods according to embodiments of the invention.

In the second approach, cap 200 can be molded with holes 202. When cap 200 is molded, pins corresponding to each desired hole 202 are positioned within a molding apparatus and held in place while the mold is formed. However, when the pins are pulled out of the mold, this may result in formation of plastic remnants that need to be removed using a method according to an embodiment of the invention.

Figure 3:
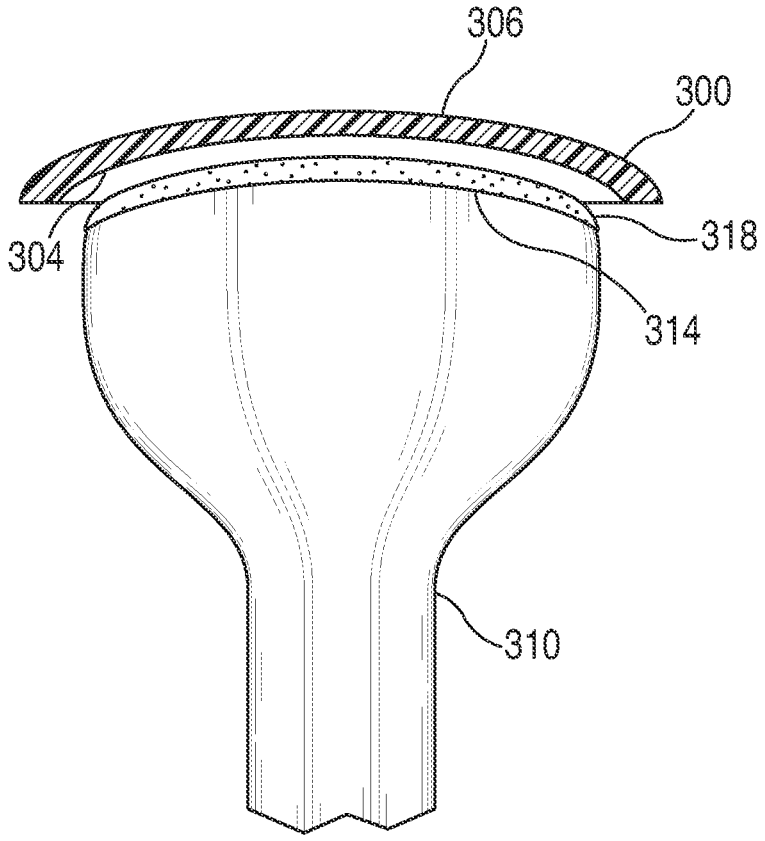
FIG. 3 shows an illustrative cross-sectional view of a cap and a deburring tool in accordance with an embodiment of the invention.

The plastic remnants can be removed using a tool shaped to match the contours of a surface of the cap and that is coated with an abrasive. Referring to FIG. 3, an illustrative cross-sectional view of cap 300 and tool 310 are shown. Cap 300 has contoured inner surface 304 and contoured outer surface 306. The holes and plastic remnants are not shown. Tool 310 has contoured surface 314 that matches the contours of inner surface 304. The contoured surface of tool 310 enables it to fit flush against all or substantially all of inner surface 304. Contoured surface 314 may be convex in shape.

Abrasive 318 is mounted to tool 310 and may mimic the contours of surface 314. Abrasive 318 may be any substance suitable for deburring plastic remnants such as, for example, a diamond coated abrasive.

Figure 4:
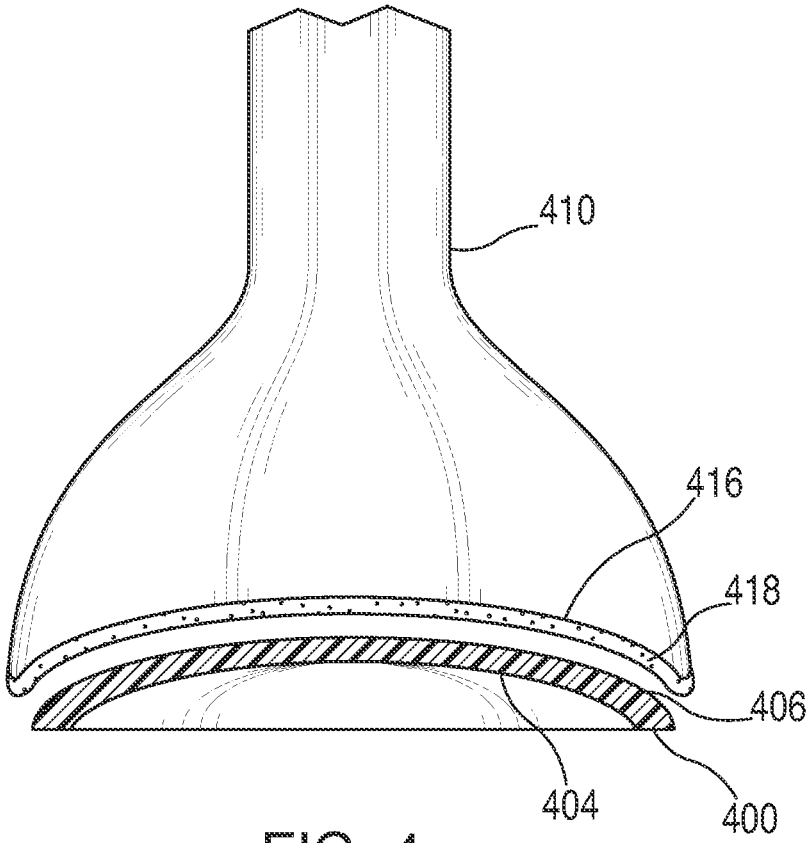
FIG. 4 shows illustrative cross-sectional views of a cap and a deburring tool in accordance with an embodiment of the invention.

FIG. 4 shows illustrative cross-sectional views of cap 400 and tool 410. Cap has inner surface 404 and outer surface 406. Tool 410 has contoured surface 416 that matches the contours of outer surface 406 and also has abrasive 418 mounted to surface 416. Tool 410 is designed to remove remnants from and polish outer surface 406 of cap 400. Contoured surface 416 may be convex in shape.

When the tool is applied to a surface of a cap, it can be ultrasonically vibrated to deburr remnants from the surface and to polish the surface. The combination of the contoured surface, abrasive, and vibration provides a cap that is both visually and tactilely aesthetically pleasing. Separate tools may be applied to both the inner and outer surfaces of the cap to deburr and polish both surfaces.

The tool can be vibrated according to any number of vibration profiles. The vibration may be an ultrasonic vibration. For example, the vibration profile can vibrate the tool at a fixed frequency for a predetermined period of time. As another example, the vibration profile can modulate the vibration of the tool so that the vibration can be selectively turned ON or OFF at any suitable frequency.

Figure 5:
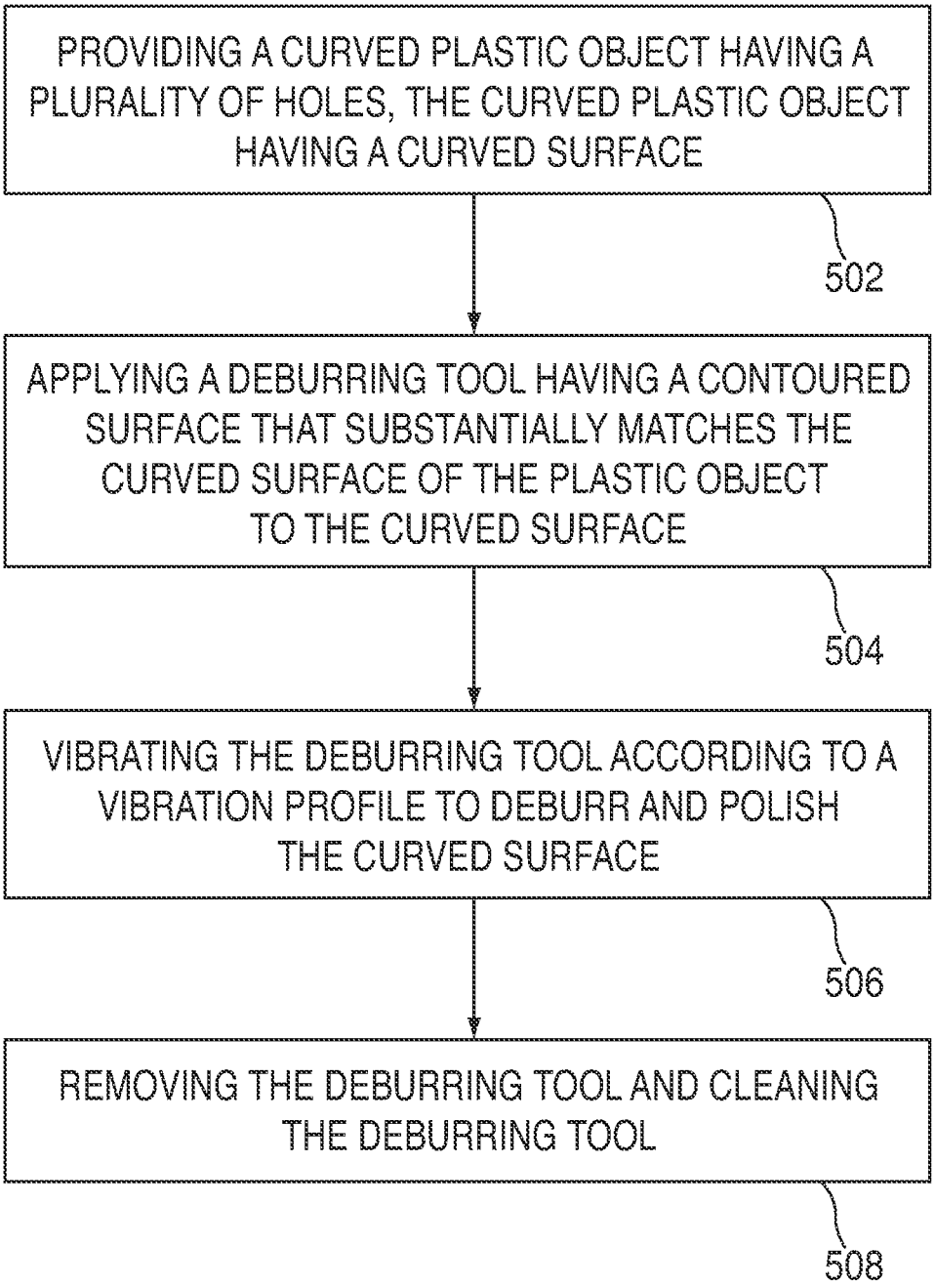
FIG. 5 shows illustrative steps for deburring and polishing a surface of a curved plastic object in accordance with an embodiment of the invention.

FIG. 5 shows illustrative steps for deburring and polishing a surface of a curved plastic object in accordance with an embodiment of the invention. Starting at step 502, a curved plastic object having several holes is provided. The curved plastic object can have a curved surface. For example, if the curved plastic object is a headphone cap, it has a curved inner surface and a curved outer surface. The creation of the holes can leave remnants disposed in and about the holes and surface of the object. In addition, the creation of the holes can also result in bumps in the inner and/or outer surfaces.

At step 504, a deburring tool having a contoured surface that substantially matches the curved surface of the plastic object is applied to the curved surface. The contoured surface of the deburring tool provides for a flush fit to the curved surface of the plastic object. In one embodiment, the tool may be constructed to fit flush against an inner surface of a headphone cap, and in another embodiment, the tool may be constructed to fit flush against an outer surface of the headphone cap. In addition, an abrasive, which is mounted to the contoured surface of the tool, can nestle into the holes when the tool is applied.

If desired, both the inner and outer surfaces of the plastic object may be deburred and polished by a deburring tool. For example, the deburring tool of FIG. 3 may be applied to the inner surface and the deburring tool of FIG. 4 may be applied to the outer surface.

At step 506, the deburring tool is vibrated according to a vibration profile to deburr and polish the curved surface. As the tool is vibrated, the abrasive strips away remnants attached to the holes and smoothes out the surface by eliminating the bumps. After the object has been deburred and polished, the deburring tool is removed and cleaned, as indicated at step 508. The deburring tool may be cleaned by agitating it against a piece of rubber. This shakes any collected remnants off the abrasive so that a relatively debris free abrasive can be applied to the next plastic object.

It should be understood that steps in FIG. 5 are merely illustrative. Any of the steps may be removed, modified, or combined, and any additional steps may be added, without departing from the scope of the invention.

The described embodiments of the invention are presented for the purpose of illustration and not of limitation.

What is claimed is:

1. A method of deburring a curved plastic object, the method comprising:

providing a curved plastic object having a plurality of holes, the curved plastic object having a curved surface;

applying a deburring tool having a contoured surface that substantially matches the curved surface of the plastic object to the curved surface of the plastic object; and vibrating the deburring tool according to a vibration profile to deburr and polish the curved surface.

2. The method of claim 1, further comprising:

removing the deburring tool and cleaning the deburring tool.

3. The method of claim 1, wherein the vibrating of the deburring tool comprises removing remnants disposed in or around the plurality of holes.

4. The method of claim 1, wherein the curved plastic object is a headphone cap, and the curved surface is an inner surface of the headphone cap.

5. The method of claim 1, wherein the curved plastic object is a headphone cap, and the curved surface is an outer surface of the headphone cap.

6. The method of claim 1, wherein the plurality of holes each have a diameter of about 0.2 mm.

7. The method of claim 1, wherein the plurality of holes are disposed in a predetermined pattern.

8. A method for deburring a curved surface of a plastic object, the curved object having a plurality of holes that terminate at the curved surface, the method comprising:

contacting an abrasive surface of a deburring tool to the curved surface of the plastic object, the deburring tool having a contoured surface that substantially corresponds to the curved surface; and vibrating the deburring tool according to a vibration profile to remove remnants disposed within and around the plurality of holes from the plastic object, wherein during the vibrating the deburring tool vibrates out the remnants disposed within the holes and the abrasive surface of the deburring tool removes the remnants around the holes, wherein the deburring tool is vibrated for a predetermined period of time.

9. The method of claim 8, wherein vibrating the deburring tool further polishes the curved surface, wherein during the polishing the abrasive strips smoothes out bumps on the curved surface.

10. The method of claim 8, wherein vibrating the deburring tool comprises ultrasonically vibrating the deburring tool.

11. The method of claim 8, wherein the vibration profile comprises vibrating the deburring tool at a fixed frequency during the predetermined period of time.

12. The method of claim 8, wherein the vibration profile comprises modulating the vibration of the deburring tool during the predetermined period of time.

13. The method of claim 8, wherein the plurality of holes range in number from about 200-1000, 300-900, 400-750, 500-600, 650-750, or 700-725.

14. The method of claim 8, wherein the curved surface is convex.

15. The method of claim 8, Wherein the curved surface is concave.

16. A method for finishing a curved surface of a portion of a headphone cap, the headphone cap having a plurality of holes disposed therethrough, wherein remnants from a prior operation remain around and within the plurality of holes, the method comprising:

contacting an abrasive surface of a deburring tool to the curved surface, the abrasive surface having a shape in accordance with the curved surface; and ultrasonically vibrating the deburring tool while the abrasive tool is contacting the curved surface such that a resultant ultrasonic vibration vibrates out remnants disposed within the hole and the abrasive surface removes remnants around the holes, wherein after the contacting and ultrasonic vibrating the curves surface around the holes is substantially smooth.

17. The method of claim 16, wherein the remnants are a byproduct of formation of the plurality of holes.

18. The method of claim 16, wherein the abrasive surface comprises diamond.

* * * * *

UNITED STATES PATENT AND TRADEMARK OFFICE

CERTIFICATE OF CORRECTION

PATENT NO. : 8,690,638 B2
APPLICATION NO. : 13/107325
DATED : April 8, 2014
INVENTOR(S) : Jeff Hayashida It is certified that error appears in the above-identified patent and that said Letters Patent is hereby corrected as shown below:

In the Claims:

Column 8, line 26 (Claim 9, line 3) replace “strips” with --surface--.

Column 8, line 58 (Claim 16, line 14) replace “curves” with --curved--.

Signed and Sealed this
Seventeenth Day of June, 2014

Michelle K. Lee

Michelle K. Lee
*Deputy Director of the United States Patent and Trademark Office*